United States Patent [19]

Knowles

[11] 4,275,643

[45] Jun. 30, 1981

[54] HYDRAULIC CONTROL SYSTEMS

[75] Inventor: James G. Knowles, Lincolnshire, England

[73] Assignee: Clayton Dewandre & Co. Ltd., Lincoln, England

[21] Appl. No.: 69,536

[22] Filed: Aug. 24, 1979

[30] Foreign Application Priority Data

Aug. 25, 1978 [GB] United Kingdom ..... 34700/78

[51] Int. Cl.[3] ..... F15B 13/02

[52] U.S. Cl. ..... 91/444; 91/446; 137/596.1; 137/596.13

[58] Field of Search ..... 91/444, 446, 451; 137/596.1, 596.13

[56] References Cited

U.S. PATENT DOCUMENTS

| | | | |
|---|---|---|---|
| 2,933,105 | 4/1960 | Jerman | 91/444 X |
| 3,807,447 | 4/1974 | Masuda | 137/596.13 |
| 3,903,786 | 9/1975 | Walters | 91/444 |
| 3,998,134 | 12/1976 | Budzich | 137/596.13 X |

*Primary Examiner*—Robert L. Bleutge

*Attorney, Agent, or Firm*—Berman, Aisenberg & Platt

[57] ABSTRACT

A control system for operating a double-acting hydraulic ram or motor, including a proportional meter-out type directional-control valve which meters the flow of fluid out of the load and, in association therewith, a combined flow and pressure-control valve in the return line from the load. The flow and pressure-control valve is responsive to the pressure drop across the meter-out orifice of the directional-control valve such that return-line flow is restricted at high pressure drops and the supply pressure to the load is increased at low pressure drops, whereby a substantially constant pressure drop across the meter-out orifice is maintained irrespective of the size or direction of the load.

5 Claims, 10 Drawing Figures

HYDRAULIC CONTROL SYSTEMS

This invention relates to systems for controlling the operation of double-acting hydraulic rams or motors, which systems incorporate a directional-control valve. Both --open- and closed-centre hydraulic directional control valves are used in such systems. While directional control valves of the proportional meter-in type, i.e. which meter or regulate the flow of pressure fluid to the load (ram or motor), have been found to have many advantages, they only work satisfactorily with a rising or positive load; with a heavy falling or negative load they revert back to the characteristics of the standard open or closed centre valve, i.e. poor metering, high pressure drop and high flow forces.

The object of the present invention is to provide a control system incorporating improved directional control means which have all the advantages of the proportional meter-in type directional-control valve whilst avoiding the disadvantages normally associated therewith.

According to the invention a control system for the purpose mentioned includes a proportional meter-out type directional-control valve which meters the flow of fluid out of the load and, in association therewith, a combined flow and pressure-control valve in the return line from the load and which is responsive to the pressure drop across the meter-out orifice of the directional control valve such that return-line flow is restricted at high pressure drops and the supply pressure to the load is increased at low pressure drops whereby a substantially constant pressure drop is obtained across said meter-out orifice independent of the size or direction of the load.

In a preferred embodiment the directional-control valve is a closed-centre type of valve having two load ports and two return ports and arranged to connect one of the load ports with the supply pressure and one with one of the return ports when the spool is moved in either direction from the central closed or neutral position. The combined flow and pressure control valve comprises a spring-loaded spool controlling the restriction in the return line and connected to the control valve by pilot lines, preferably switched in response to displacement of the directional-control-valve spool, for applying the pressure downstream of the meter-out orifice to act on the spool with the spring in opposition to the pressure upstream of the meter-out orifice. In addition there is an unloader spool valve connected in the supply pressure line and also connected by a pilot pressure line to the combined flow and pressure-control valve also controlling a restriction in the unloader pilot flow to regulate the supply pressure.

Embodiments of the invention will now be described by way of example with reference to the accompanying drawings of which:

Figure 1:
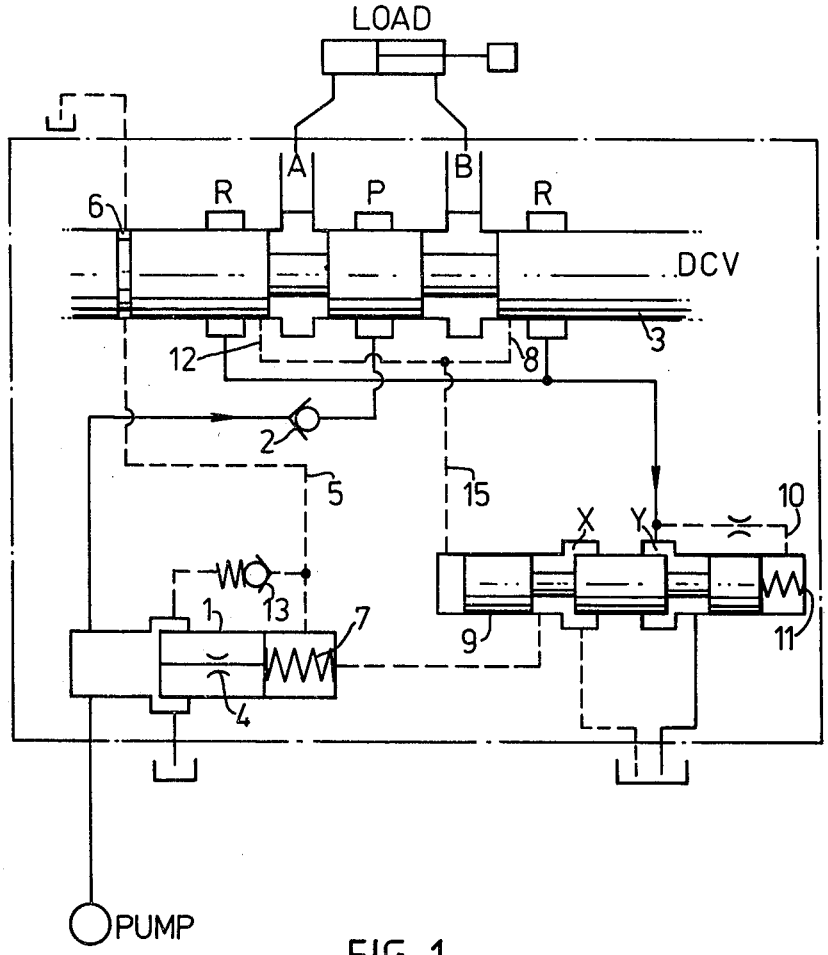
FIG. 1 is a hydraulic circuit diagram of a control system according to this invention.
Figure 8:
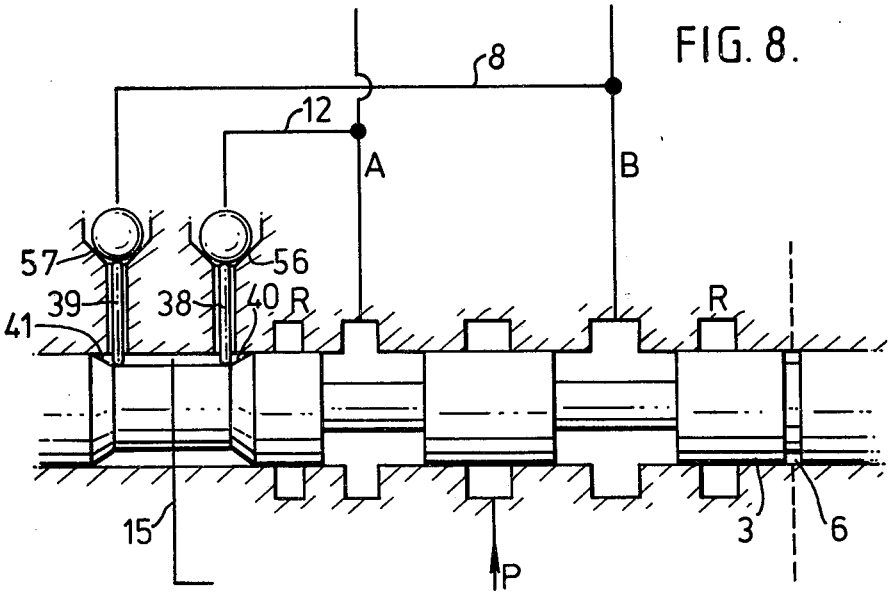
Figure 9:
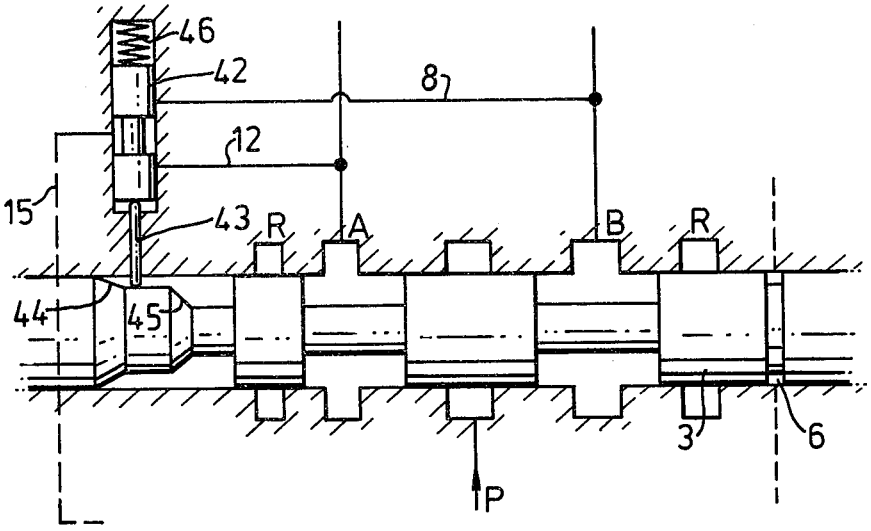
Figure 10:
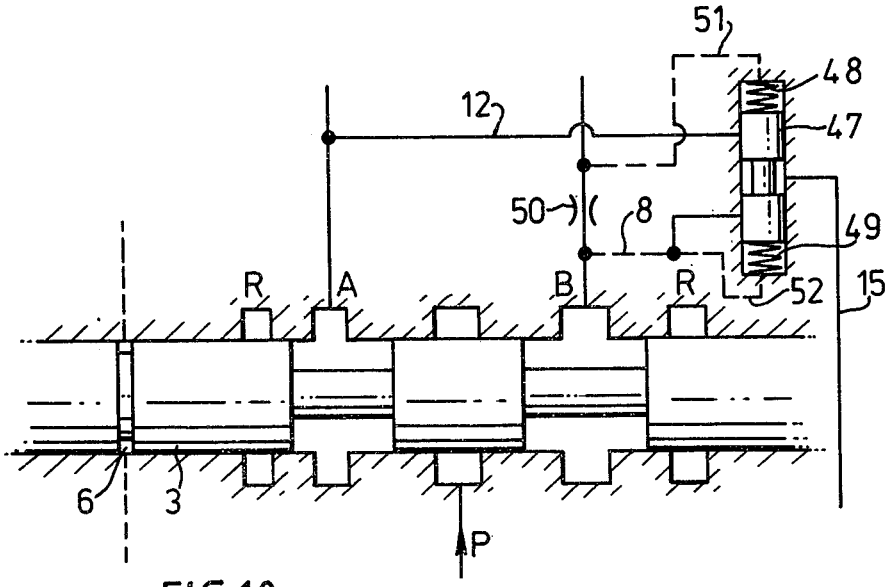

FIGS. 8 to 10 each show alternative direction control valves for use in the system of FIG. 1.

In the basic control system of FIG. 1, with the directional-control valve in the neutral position as shown, pump pressure acts on the inlet face of an unloader spool 1, and across the check valve 2 into the annular chamber P, which is blocked by the spool 3 of the directional-control valve. A small pilot flow of oil passes through a restricted orifice 4 of the unloader spool, along pilot line 5 and through the open pilot switch 6 to drain. This creates a pressure drop across the restricted orifice 4, sufficient to open the unloader spool 1 against its spring load 7 thus allowing the pump flow to pass through the unloader valve to drain at low pressure.

When the directional-control-valve spool 3 is selected to the right, the pilot line 8 leading to the non-spring end of a combined flow and pressure-control valve 9 opens and the P to A port opens, connecting the pump to the load (ram or motor). Further movement closes the unloader pilot switch 6 and opens the B to R port, allowing oil to return from the load via the valve 9 to drain. The upstream pressure of the service line B to R metering orifice is fed via pilot lines 8 and 15 to the non spring end of the spool of valve 9 and the downstream pressure is transmitted to the spring end of said spool via pilot line 10. The pressure drop across the B to R metering orifice is therefore transmitted across the spool of valve 9 such that, at pressure drops greater than the equivalent spring load 11, orifice Y tends to close and orifice X tends to open, and at pressure drops less than the equivalent spring load 11, orifice Y tends to open and orifice X tends to close. Orifice Y therefore opens or closes, increasing or decreasing the return-line flow until the pressure drop across the B to R metering orifice is equal to the equivalent pressure set up by the spring 11. In this way it acts as an in-line flow-control valve, maintaining a constant pressure drop across the B to R orifice and the return-line flow, and hence the speed of the load, is proportional to the size of the meter-out orifice in service line B to R.

With a falling load, i.e. one which pressurises the return-line, opening orifice Y, increases the return-line flow and closing orifice Y, decreases the return-line flow, and the system operates as previously stated. However, with a rising load, i.e. one which pressurises the supply line, the system operates by regulating the supply pressure to obtain the return-line flow required by the meter-out orifice B to R. With the unloader pilot switch 6 closed, all the unloader pilot flow passes through orifice X of the valve 9 before reaching drain. The size of orifice X therefore determines the pressure at the spring end of the unloader spool 1 and hence the supply pressure to the load. Increasing the pressure at the spring end of the unloader causes the unloader spool 1 to tend to close, thereby decresing the flow of oil escaping to drain across the unloader, and increasing the supply flow and pressure to the load. Decreasing the pressure at the spring end of the unloader has the opposite effect and decreases the supply flow and pressure to the load. The unloader spool 1 regulates the supply pressure until a state of equilibrium is reached and the pressure drop across the unloader spool 1 is equal to the equivalent pressure of the spring 7. The spring 7 therefore maintains a fairly constant pressure drop across the unloader spool 1 and hence the restricted orifice 4 of the unloader spool, and the unloader pilot flow is therefore constant. Hence, the supply pressure is dependent upon the pressure at the spring end of the unloader spool 1, which in turn is solely dependent upon the size of the metering orifice X of the valve 9, since the unloader pilot flow is constant. Orifice X, in conjunction with the unloader therefore acts as a pressure-control valve and regulates the supply pressure.

Since orifice X is regulated by the pressure drop across the meter-out orifice in service line B to R at low pressure drops, orifice X tends to close, thereby increasing the supply flow and pressure to the load, and hence the return flow from the load, until the B to R pressure drop is increased sufficiently to balance the spring load 11. At high pressure drops, orifice X tends to open, thereby decreasing the supply flow and pressure to the load and the return flow from the load, until the B to R pressure drop is again equal to the equivalent spring load 11. Therefore the pressure drop across the B to R orifice is maintained constant, for a rising load, as it is for a falling load, and the return line flow and hence the speed of the load, is proportional to the size of the meter-out orifice of service line B to R and is independent of both the size and direction of the load.

Similarly, relating the directional-control-valve spool 3 to the left opens pilot line 12 to the non-spring end of the spool of valve 9 and the system operates as before, regulating return-line flow from the load proportional to the size of the meter-out orifice in service line A to R and independently of load size or direction.

The system can also contain a pilot line relief valve 13, although this is not fundamental to the circuit, which sets a pressure limit on the unloader pilot flow at the spring end of the unloader spool 1. In so doing, a pressure limit is set on the supply pressure, since the pressure drop across the unloader is constant, as explained previously, and the pilot-line relief valve, together with the unloader, forms a pilot-operated relief valve.

Figure 2:
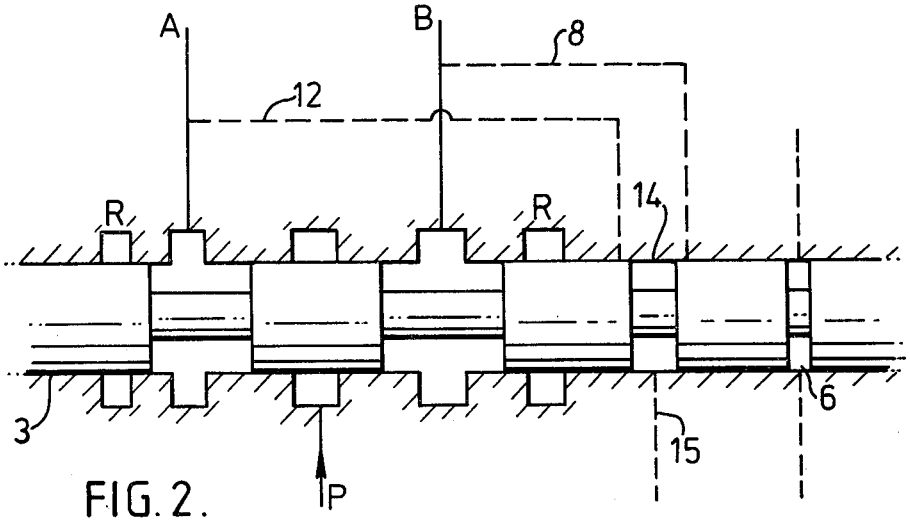
FIG. 2 is a diagram of an alternative form of FIG. 1.

The pilot lines 8 and 12, which are used to transmit the upstream pressure of the selected meter-out orifice, to the non-spring end of the control valve 9 can be selected by the spool 3 of the directional-control valve in a number of different ways, the general requirements of the system being that the pilot lines must be sealed when the spool 3 is in neutral position to prevent service port leakage (not necessary if the load actuator is a motor with freewheel or if lock valves are fitted to the service lines A and B) and that the selected line must remain open regardless of load size or direction. A preferred system is shown in FIG. 2 where pilot lines 8 and 12 transmit service port pressures to a pilot line switch 14, situated on the spool 3. When the spool 3 is selected, the appropriate pilot line 8 or 12 is connected to pilot line 15 which leads to the non-spring end of the spool of control valve 9. This system has the advantage over that shown in FIG. 1 that a shorter stroke of the spool 3 is required since the pilot lines 8 or 12 can be opened at the same time as the meter-out orifice is opened.

An alternative system is shown in FIG. 8 where pilot lines 8 and 12 are closed, when the main spool 3 is in neutral, by check valves 56 and 57. These are selectively opened by push rods 38 and 39 when the main spool 3 is selected to the right or to the left, by the mechanical action of the cam faces 40 and 41 on the main spool 3. The service port pressure is then transmitted via pilot line 15 to the non-spring end of the combined flow and pressure control valve 9.

Another alternative system is shown in FIG. 9 where pilot lines 8 and 12 are closed, when the spool 3 is in neutral by a 3-way spool valve 42. This is selected to open either pilot line 8 or pilot line 12 to pilot line 15 by the mechanical action of spring 46, push rod 43 and cam faces 44 or 45.

Another alternative system is shown in FIG. 10 where pilot lines 8 and 12 are closed, when the main spool 3 is in neutral, by a spool of the 3-way spool valve 47. This is selected to open either pilot line 8 or pilot line 12 to pilot line 15 by the pressure drop across an orifice 50 situated in the service line B. With the spool 3 selected to the right, flow from the load creates a pressure drop across orifice 50, transmitted by pilot lines 51 and 52 to the ends of a spool of the 3-way spool valve 47, sufficient to select a spool of the 3-way spool valve 47 against spring load 49, and open pilot line 8 to pilot line 15. When the spool 3 is selected to the left, flow into the load creates a pressure drop across orifice 50 sufficient to select a spool of the 3-way spool valve 47, against spring load 48, and open pilot line 12 to pilot line 15.

Figure 3:
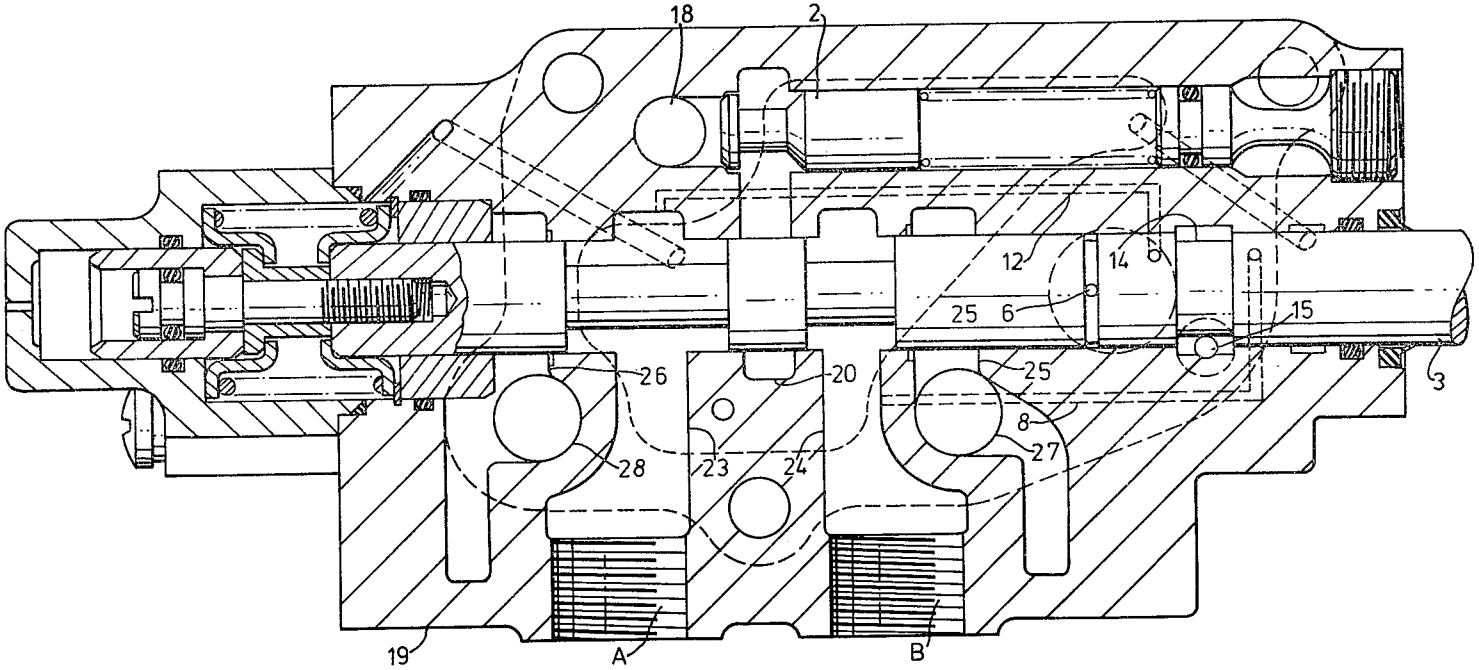
FIG. 3 is a section through a proportional directional control valve for use in the system of meter-out directional control valve.
Figure 4:
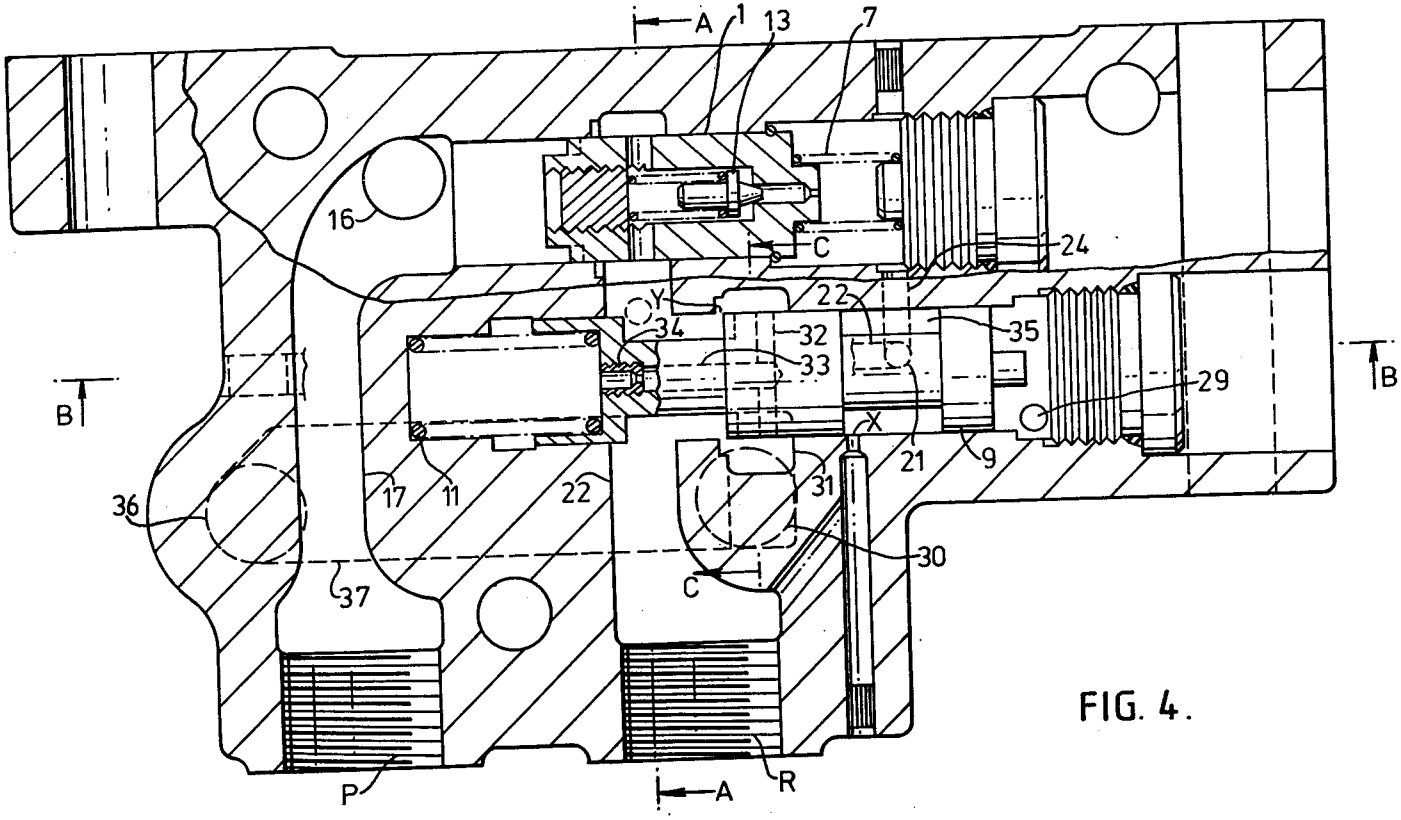
FIG. 4 is a section through an inlet block which houses the unloader valve, relief valve and the combined flow and pressure control valve.
Figure 6:
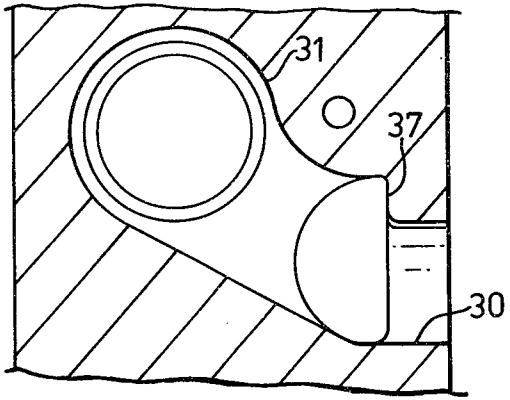
FIG. 6 is a section at C—C through the inlet block.
Figure 5:
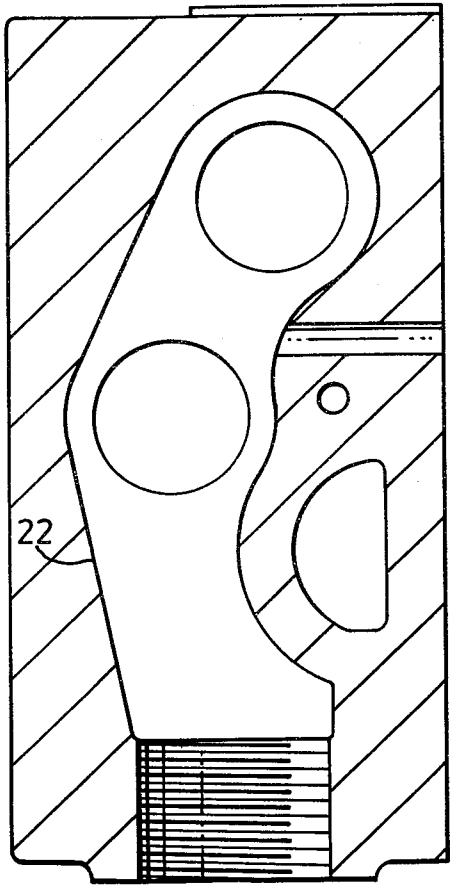
FIG. 5 is a section at A—A through the inlet block.

Referring now to FIGS. 3 to 7, oil enters the inlet block FIG. 4, via the annular chamber P and pump pressure is fed along passage 17, through hole 16, into the corresponding supply hole 18 in the proportional meter-out directional-control-valve block 19 in FIG. 3. With the directional-control-valve spool 3 in neutral, as drawn, service lines A and B are blocked and pump pressure is contained in chamber 20. The unloader pilot flow passes from passage 17, through the restricted orifice 4 of the unloader spool, FIG. 7, out through passages 22 and 21 into the valve block 19, FIG. 3, and through the open unloader pilot switch 6 into an outlet block, not shown, and back to drain. The pressure drop created across the restricted orifice 4 of the unloader spool is fed via passage 17, FIG. 4, to the non-spring end of the unloader spool 1 and via passages 22 and 24, FIGS. 4 and 7, to the spring end of the unloader spool 1, and is sufficient to open the unloader to the return-line passage 22, thus allowing the pump flow to return to drain at low pressure.

With the spool 3 selected to the right, chamber 20 is opened to passage 23, to allow oil to flow into the load; and the combined flow and pressure-control-valve pilot switch is opened; further movement of the spool 3 opens chamber 24 to passage 25 to allow oil to flow out of the load; and the unloader pilot switch 6 closes. The pressure in passage 24, i.e. upstream of the meter-out orifice, is fed via passage 8, through the open pilot switch 14 into pilot line 15, out of the valve block 19 and into the inlet block, FIG. 4, at passage 29, to act on the non-spring end of the spool of valve 9. Pressure in chamber 25, i.e. downstream of the meter-out orifice, is fed out of the valve block 19 via passage 27 and into the inlet block, FIGS. 4 and 6, at passage 30 and into the annular chamber 31 around the spool of valve 9 and via passages 32 and 33 in spool 9, to act on the spring end of said spool. Flow from the load in passage 24, FIG. 3, passes through the meter-out orifice into chamber 25 through passage 27 and into the inlet block at passage 30, FIGS. 4 and 6, around annular chamber 31, through orifice Y of the spool of valve 9 and into the return passage 22 and back to drain. The pressure drop created across the meter-out orifice by the return-line flow from the load is therefore transmitted across the spool of valve 9 such that, at pressure drops greater than the equivalent spring load 11, orifice Y tends to close and orifice X tends to open; and for pressure drops less than the equivalent spring load 11, orifice Y tends to open and orifice X tends to close. Thus for a falling load, i.e. one which pressurises the return line, orifice Y opens or closes until the pressure drop across the meter-out orifice is equal to the equivalent spring load 11. Orifice Y, therefore, acts as an in-line flow-control valve and regulates the return-line flow to maintain a constant pressure drop across the meter-out orifice approximately equal to the equivalent pressure of spring 11.

Figure 7:
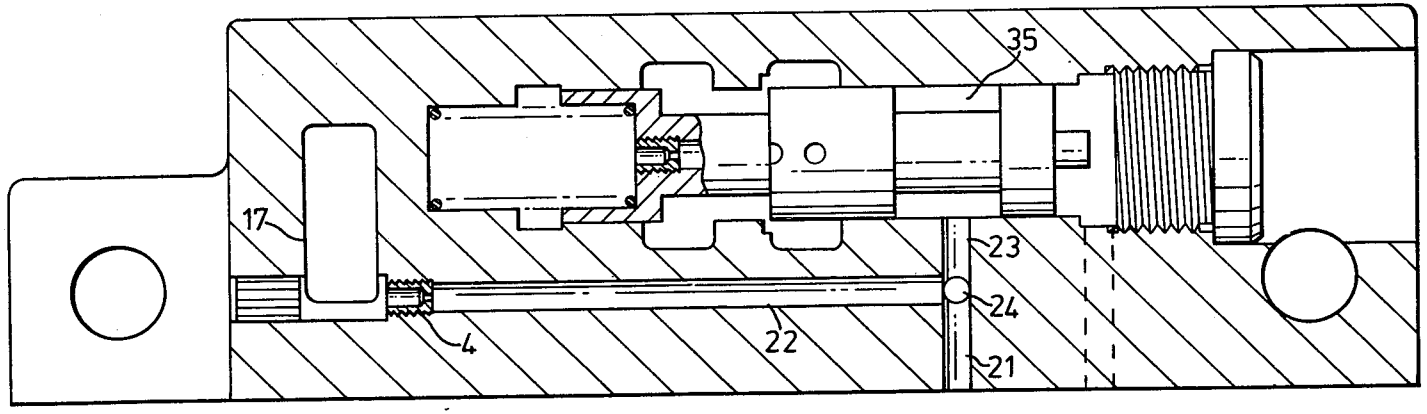
FIG. 7 is a section at B—B through the inlet block.

Since the unloader pilot switch 6 is closed, unloader pilot flow passes from passage 17, FIG. 7, through the unloader orifice 4 and along passages 22 and 23 into chamber 35 in the spool of valve 9, through orifice X, FIG. 4, and into the return passage 22 and back to drain. The pressure drop across the unloader spool 1 is maintained constant by its spring 7; the unloader spool, regulates the supply flow and pressure until the pressure at the non-spring end of the unloader spool 1 is approximately equal to the equivalent pressure of the spring 7 above the pressure at the spring end of the unloader spool 1. The pressure drop across the unloader orifice 4 is therefore fairly constant and the unloader pilot flow is also constant, as explained previously. Hence the pressure drop across the control orifice X of the spool of control valve 9 determines the pressure at the spring end of the unloader spool 1 and therefore the supply flow and pressure to the load.

With a rising load, i.e. one that pressurises the supply line to the load, at low pressure drops across the meter-out orifice, the opening of orifice Y may have no effect, but further movement of the spool of control valve 9 tends to close orifice X and hence increase the supply flow and pressure to the load. This in turn increases the return flow from the load, until the pressure drop across the meter-out orifice is equal to its equivalent spring load 11. At high pressure drops across the meter-out orifice, orifice X tends to open, thus decreasing the supply flow and pressure and hence the return-line flow until the pressure drop across the meter-out orifice is again equal to its equivalent spring load.

Orifice X, in conjunction with the unloader spool 1, therefore, operates as a pressure-control valve, regulating the supply flow and pressure to the load to maintain a constant pressure drop across the meter-out orifice.

Hence for both rising and falling loads the pressure drop across the meter-out orifice is maintained fairly constant and the return line flow and therefore the speed of the load is proportional to the size of the meter-out orifice, and is independent of both the size and direction of the load.

Similarly, selecting the directional control spool 3, FIG. 3, to the left, connects the supply chamber 20 to passage 24 to supply fluid to the load via port B and opens pilot switch 14, further movement to the left opens passage 23 to passage 26, to allow fluid from the load to return to drain via service line A, and closes the unloader pilot switch 6. Return-line flow from passage 26 flows through passage 28 into the inlet block at passage 36, FIG. 4, along passage 37, around annular chamber 31 and is metered by control orifice Y before passing to drain via passage 22. Pressure at passage 23, FIG. 3, is transmitted along pilot line 12, through the open pilot switch 14, out of the directional-control-valve block via pilot line 15 and into the inlet block at passage 29, FIG. 4, to act on the non-spring end of the spool of valve 9. The spool of valve 9 therefore responds to the pressure drop across the A to R meter-out orifice and the system operates as previously described.

The unloader spool 1, FIG. 4, can also be made to operate as a pilot-operated relief valve to protect the pump supply from over pressurisation by the addition of a small pilot relief valve 13 which limits the pressure at the spring end of the unloader spool 1. The pressure at the non-spring end of the unloader spool 1 is, therefore, also limited since a constant pressure drop exists over the unloader spool 1.

A damping orifice 34 may be fitted to the spring end of the spool of valve 9 to stabilize the spool against pump and load fluctuations, but it has no effect on the steady-state operation of the system as described previously.

What is claimed is:

1. A control system for operating a double-acting hydraulic ram or motor, comprising a proportional meter-out type directional control valve having a spool and a meter-out orifice, a combined flow and pressure control valve having a spring-loaded spool and being in association with the directional control valve, a supply line, a load, a return line from the load, an unloader spool valve, a pilot line and a supply pressure line; the directional control valve constituting means to meter fluid flow from the load; the unloader spool valve being connected by the pilot line to the combined flow and pressure control valve, being connected in the supply line and being responsive to a pressure drop across a restricted orifice, thus providing means to maintain unloader pilot flow substantially constant and independent of supply flow changes; the spring loaded spool providing means to control a restriction in the unloader pilot flow and thus regulate pressure in the supply pressure line; the combined flow and pressure control valve being in the return line and responsive to a pressure drop across the meter-out orifice so that return-line flow is restricted at high pressure drops and supply pressure to the load is increased at low pressure drops, whereby a substantially constant pressure drop is effected across said meter-out orifice independent of load size or direction.

2. A system according to claim 1 wherein the directional control valve is a closed centre type of valve having two load ports and two return ports and arranged to connect one of the load ports with the supply pressure and one with one of a return ports when the spool is moved in either direction from the central closed or neutral position.

3. A system according to claim 2 wherein the combined flow and pressure control valve comprises a spring-loaded spool controlling restriction in the return line and connected to the control valve by pilot lines for applying the pressure downstream of the meter-out orifice to act on the spool with the spring in apposition to pressure upstream of the meter-out orifice.

4. A system according to claim 3 wherein the upstream pilot pressure line has two connections with the directional control valve of which both are closed in the neutral or centre position of the valve and each one opens to communicate with one or other of the load ports when the valve is displaced from a neutral position.

5. A system according to claim 4 wherein communication via the said two connections is controlled by switch means operable in response to displacement of the directional control valve.

* * * * *